US008132649B2

(12) United States Patent
Rogers

(10) Patent No.: US 8,132,649 B2
(45) Date of Patent: Mar. 13, 2012

(54) TWIST LOCK COUPLING SPIGOT

(76) Inventor: Peter J. Rogers, Barrie (CA)

( * ) Notice: Subject to any disclaimer, the term of this patent is extended or adjusted under 35 U.S.C. 154(b) by 627 days.

(21) Appl. No.: 12/260,835

(22) Filed: Oct. 29, 2008

(65) Prior Publication Data

US 2010/0025556 A1 Feb. 4, 2010

(30) Foreign Application Priority Data

Jul. 29, 2008 (CA) ..... 2638365

(51) Int. Cl.
*E04G 7/00* (2006.01)

(52) U.S. Cl. ..... 182/178.6; 403/49; 403/293

(58) Field of Classification Search ..... 403/18, 403/33, 49, 93, 96, 109.1, 109.2, 109.6, 109.8, 403/348, 349, 378, 349.4, 349.5, 292, 293; 182/186.7, 186.8; 256/DIG. 5; 248/125.8, 248/159, 161, 410

See application file for complete search history.

(56) References Cited

U.S. PATENT DOCUMENTS 1,034,338 A * 7/1912 Beatty ..... 403/175
4,015,395 A * 4/1977 Gostling ..... 52/637
4,039,264 A * 8/1977 Sharp ..... 403/246
4,348,128 A * 9/1982 Gostling ..... 403/49
4,577,449 A * 3/1986 Celli ..... 403/191
4,586,844 A * 5/1986 Hammonds et al. ..... 403/287
4,587,786 A * 5/1986 Woods ..... 52/638
5,074,548 A * 12/1991 Sawyer ..... 482/76
5,127,492 A * 7/1992 Preston ..... 182/152
5,259,690 A * 11/1993 Legge ..... 403/385
5,702,198 A * 12/1997 Kuo ..... 403/377
6,854,916 B2 * 2/2005 Hsieh ..... 403/109.3
7,090,052 B2 * 8/2006 Arnault et al. ..... 182/186.8

FOREIGN PATENT DOCUMENTS

GB 2085107 A * 4/1982
GB 2117478 A * 10/1983
JP 2004116070 4/2004

* cited by examiner

*Primary Examiner* — Michael P Ferguson
*Assistant Examiner* — Nahid Amiri

(57) ABSTRACT

A coupling spigot for connecting two scaffold legs one atop the other is designed to use a twist lock for securing the upper scaffold leg to the coupling spigot. A locking collar is fixed to a stop collar of the spigot. The locking collar includes receiving slots for receiving locking projections provided adjacent a bottom edge of the scaffold leg. Locking slots are connected to the receiving slots whereby an upper scaffold leg may be inserted on a coupling spigot of a lower scaffold leg and retained thereon by a twist lock.

11 Claims, 8 Drawing Sheets

TWIST LOCK COUPLING SPIGOT

FIELD OF THE INVENTION

The present application relates to coupling spigots for use in association with scaffold legs, and in particular, relates to a coupling spigot having a locking collar.

BACKGROUND OF THE INVENTION

Most scaffolding systems include scaffold legs that are connected in an end to end manner to form an upright column. Typically, a spigot-type arrangement is used to connect a lower scaffold leg to an upper scaffold leg. In some scaffolding systems, the spigot is an integral part of the top portion of the scaffold leg often formed by seeming to reduce the diameter at the end, and the bottom portion of the scaffold leg is slightly enlarged or bell mouthed to receive the spigot. Other scaffolding systems use a separate spigot member that is inserted in a lower end of an upper scaffold leg, and a lower portion of the spigot is inserted in the end of the lower scaffold leg. Typically, the spigot is attached by a removable gravity lock pin, such as a pigtail pin, to the lower portion of the upper scaffold leg. A clevis pin may be used to secure the spigot to the upper portion of a scaffold leg and scaffold legs abut end to end.

With independent spigot arrangements as well as the integral spigot, there is often a requirement to provide a positive lock of the scaffold legs to each other. In case of the integral spigot arrangement, this is typically a gravity lock pin, such as a pigtail pin, inserted through a port in the upper scaffold leg, and through an aligned port in the spigot portion such that the pin passes from one side of the scaffold leg to the other side. This gravity lock pin forms a positive lock of the scaffold legs one to the other. In the case of an independent spigot, a clevis pin may be used to mechanically secure a bottom portion of the spigot to the lower scaffold leg, and a gravity lock pin typically secures the upper scaffold leg to the upper portion of the spigot.

In some scaffold applications it is desirable to have a number of speciality components that can be inserted into the top or bottom of the scaffold leg. To satisfy these applications, an independent spigot is preferred as it allows more flexibility with respect to the connection of speciality components.

Although scaffolding systems are designed to allow mechanical securement of the scaffold legs one to the other (by bolts for example), this procedure is not always completed, creating a significant safety risk. Safety inspectors often shut down a job site until such safety procedures are complied with. It is desirable to provide a system where the securement of stacked scaffold legs is simplified.

SUMMARY OF THE INVENTION

In the present invention, a simple twist lock arrangement is used where a locking collar includes at least one receiving slot for receiving a locking projection of an upper scaffold leg. The recessed slot is associated with a locking slot in the locking collar. When the upper scaffold leg is inserted onto the spigot, the locking projection of the upper scaffold leg passes through the receiving slot and is aligned with the locking slot when the scaffold leg is supported on the stop collar. The upper scaffold leg may then be rotated approximately 45 degrees to restrict the locking projection within the locking slot. This provides a simple and strong mechanical connection of one scaffold leg to the other. Furthermore, as the locking procedures are associated with the mounting of the upper scaffold leg on the upper portion of the coupling spigot, the workman will complete this process as it is simple and straight forward. For safety inspectors, it is a simple visual procedure to determine whether the upper scaffold leg is locked to the lower scaffold leg. Preferably, the lower scaffold leg includes a clevis pin or bolt type arrangement for securing of the coupling spigot to the lower leg.

According to an aspect of the invention, the locking collar includes a second locking slot and a second receiving slot in a locking collar that additionally receives the locking projection of the upper scaffold leg. In this case, the locking projection includes projections either side of the lower end of the upper scaffold leg.

In a further aspect of the invention, the locking collar is non-pivotally secured to the spigot.

In yet a further aspect of the invention, the locking collar is integrally connected to the stop collar of the coupling spigot.

In a preferred aspect of the invention, the coupling spigot uses four receiving gaps and four locking slots providing a series of orientations in which the upper scaffold leg may be inserted on and connected to the coupling spigot.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
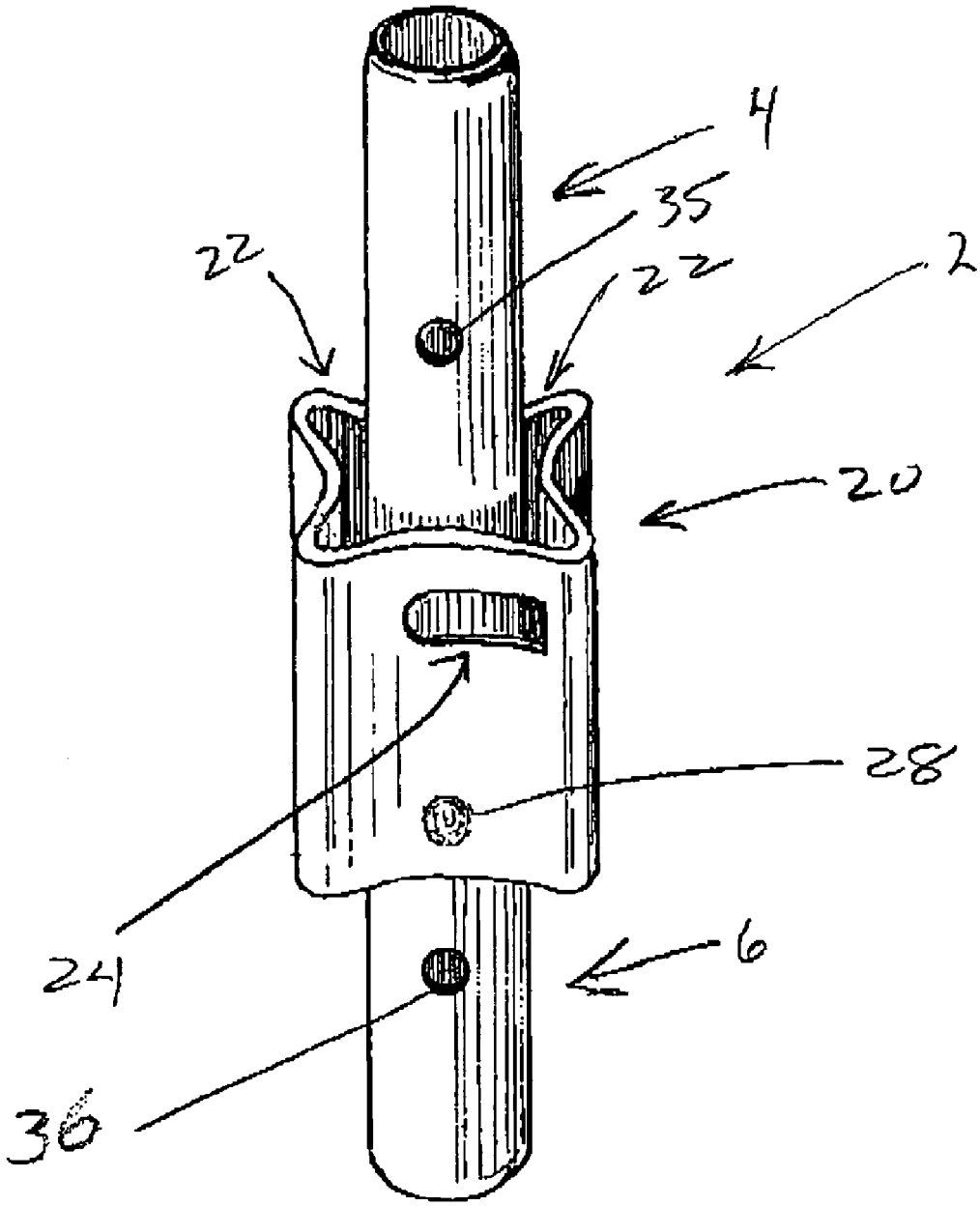
FIG. 1 is a perspective view of the coupling spigot.
Figure 2:
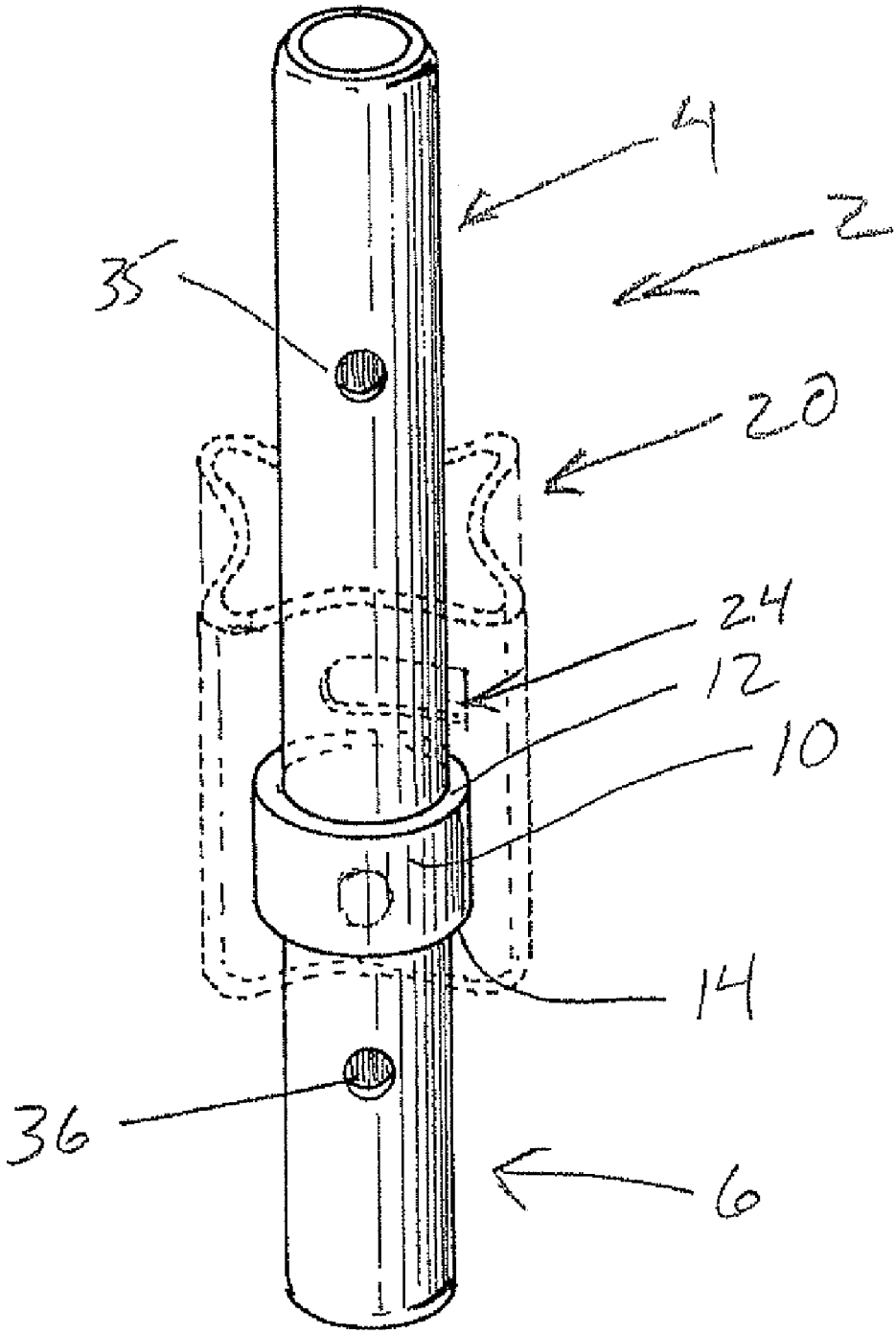
FIG. 2 is a perspective view of the coupling spigot with the locking collar shown in dotted lines.

The coupling spigot 2 shown in FIGS. 1 and 2 includes an upper portion 4 and a lower portion 6 with a stop collar 10 located between and separating these portions. The upper portion 4 is received in an upper scaffold leg, and the lower portion 6 is received in a lower scaffold leg to form a strong mechanical connection. The stop collar includes an upper surface 12 for engaging the upper scaffold leg, and a lower surface 14 for engaging the lower scaffold leg.

Attached to the stop collar, as generally shown in FIG. 2, is the locking collar 20. The locking collar 20 projects above the stop collar and includes four receiving slots 22, with each receiving slot having an associated locking slot 24. The locking collar is connected to the stop collar by a series of welds shown as 28. The locking collar includes four outward projections that form the receiving slots 22. The collar between these receiving slots curves inwardly and is of reduced diameter for securement to the stop collar while leaving a gap above the stop collar for receiving the upper scaffold leg. The locking slots 24 are associated with the base of the receiving slots 22 and extend in a generally perpendicular manner from one side of the receiving slots. The receiving slots and locking slots form an L-shape type slot arrangement.

Figure 3:
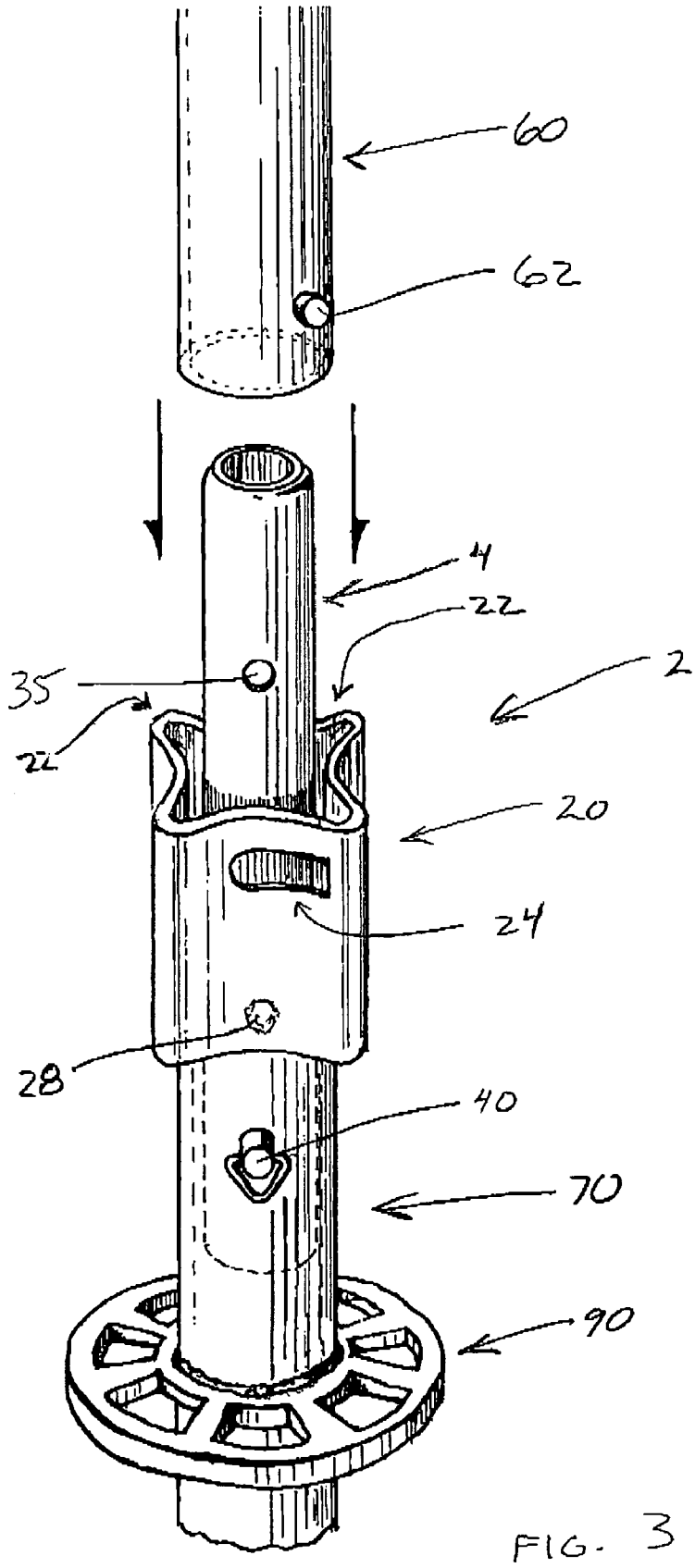
FIG. 3 is a partial exploded perspective view showing the coupling spigot connected to a lower scaffold leg and the bottom portion of an upper scaffold leg about to be inserted on the coupling spigot.
Figure 4:
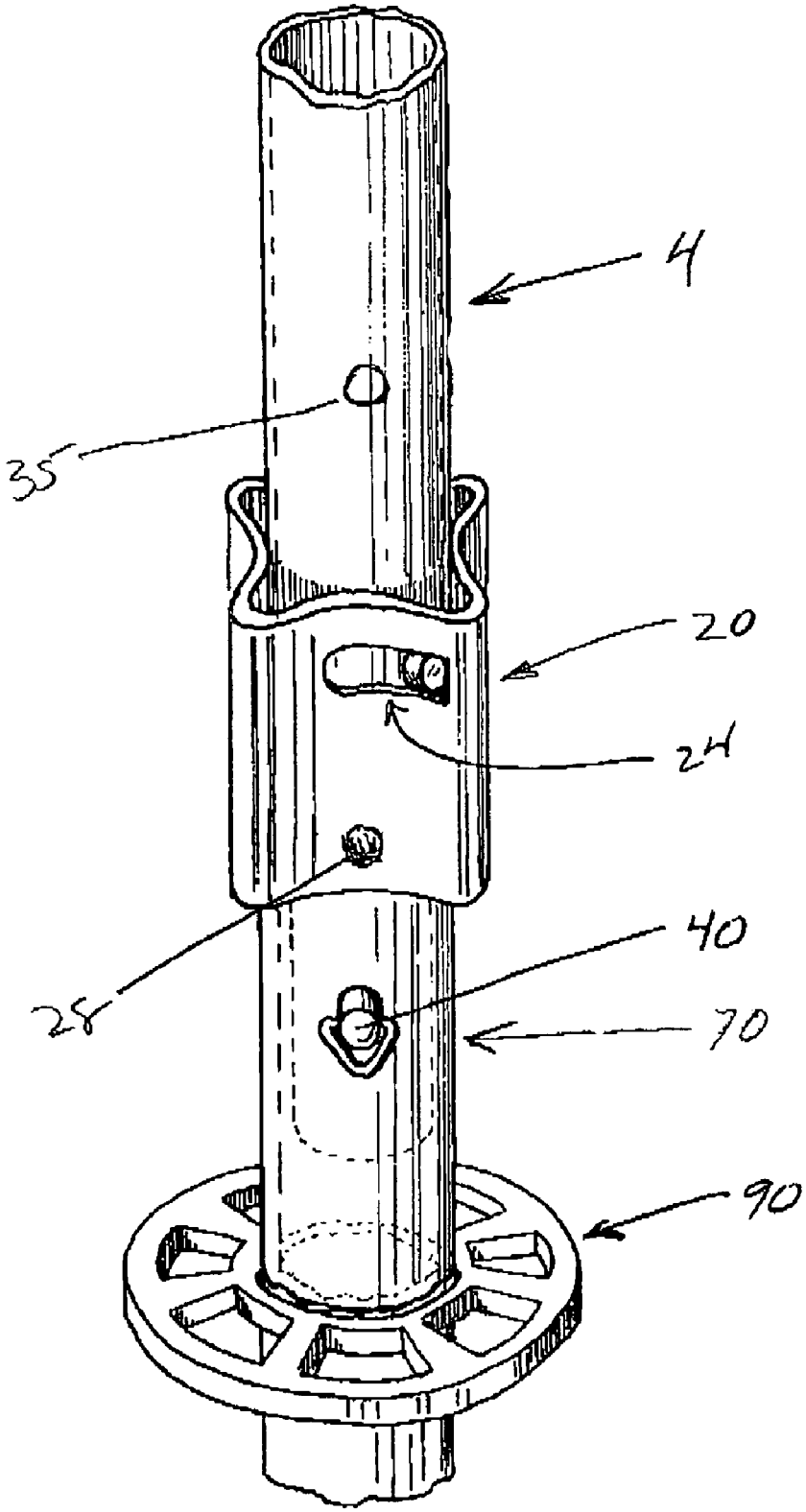
FIG. 4 is a partial perspective view of the coupling spigot connected to a lower scaffold leg with an upper scaffold leg being received in the locking collar, but not yet moved to a locking position.
Figure 5:
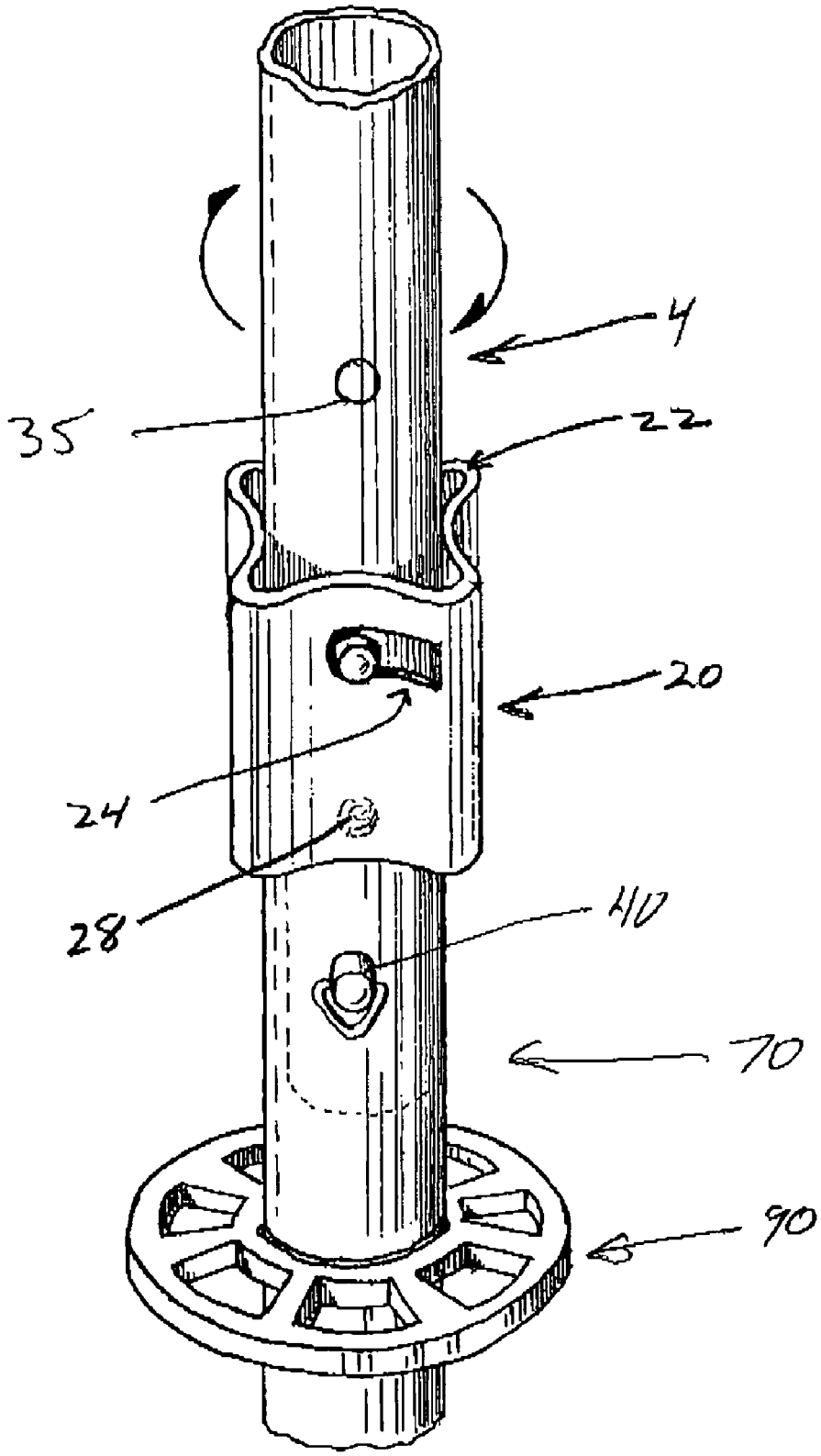
FIG. 5 is a perspective view similar to FIG. 4 with the upper scaffold leg rotated to lock the locking projection in the locking slot of the locking collar.
Figure 6:
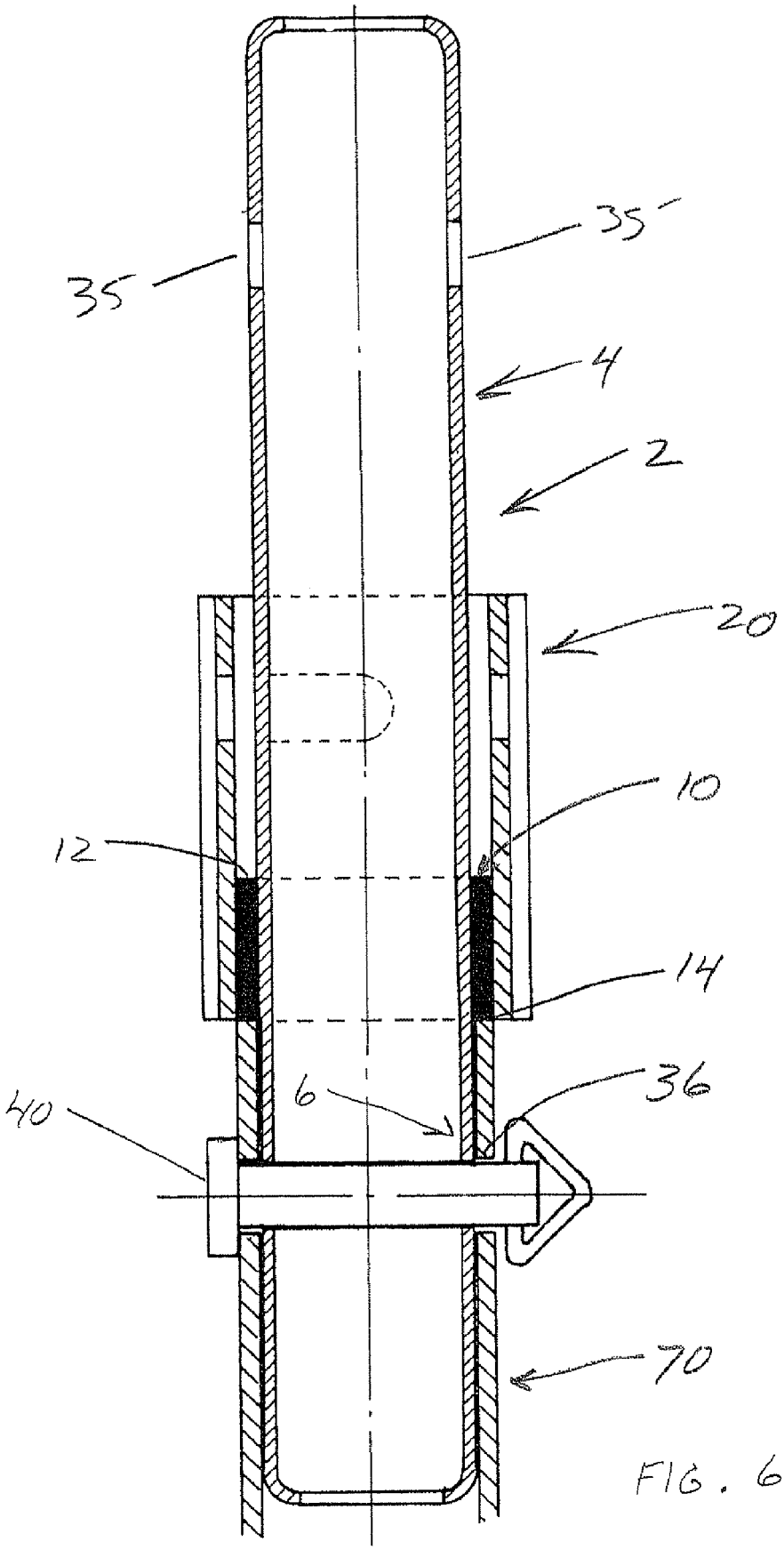
FIG. 6 is a partial sectional view showing the coupling spigot secured to a lower scaffold leg.
Figure 7:
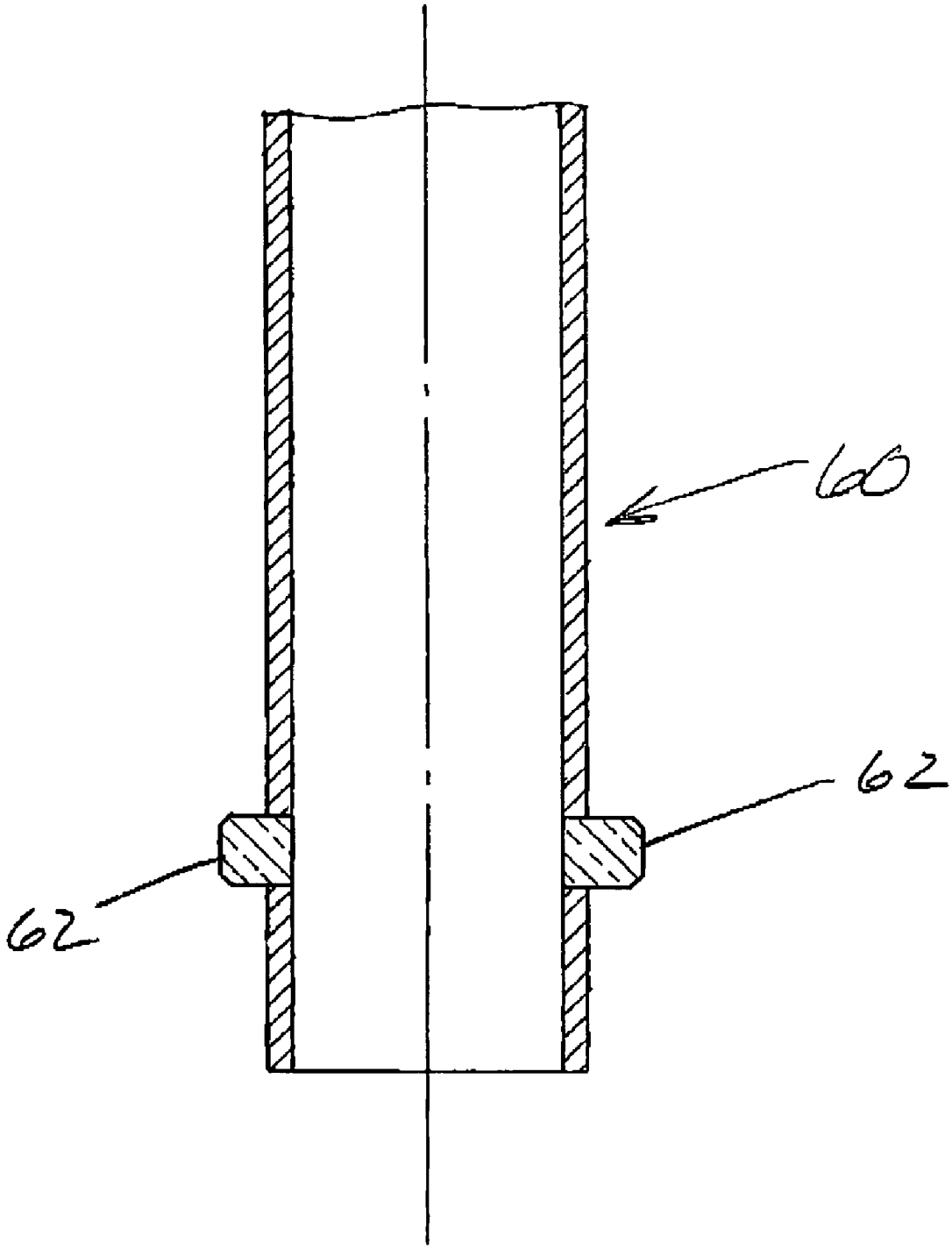
FIG. 7 is a partial sectional view through the lower portion of a scaffold leg showing the locking projections.

The coupling spigot 2 is designed to twist lock with the lower portion of an upper scaffold leg that includes locking projections 62 as shown in FIG. 3 and the sectional view of FIG. 7. These locking projections do not extend through the lower portion of the scaffold leg as this portion is designed to sleeve over the upper portion 4 of the coupling spigot 2. The locking projections 62 are aligned with the receiving slots 22 and allow the upper scaffold leg 60 to slide over the upper portion 4 of the coupling spigot 2 until the scaffold leg bottoms out on the stop collar. At this point, the locking projections 62 are aligned with the locking slots 24 and rotation of the upper scaffold leg as shown in FIG. 5 locates the locking projections 62 at the end of the locking slots 24. In this position, the upper scaffold leg is fixed to the locking collar and it is not possible to axially separate the upper scaffold leg from the locking collar without a reverse rotation of the upper scaffold leg. As can be appreciated, this provides a simple mechanism for securing of the upper scaffold leg to the locking collar 20.

The coupling spigot 2 is also connected to the lower scaffold leg 70 by means of the clevis pin 40 or a nut and bolt securement. The clevis pin 40 passes through ports in the upper portion of the scaffold leg 70 and through ports 36 provided in the coupling spigot 2. Thus, the coupling spigot 2 is preferably mechanically secured to the upper portion of a scaffold leg by a clevis pin-type arrangement. In contrast, the upper scaffold leg includes projections 62 that pass through the receiving slots and engage the locking slots 24 once the upper scaffold leg has been rotated approximately 45 degrees. This provides a positive securement of the upper scaffold leg to the lower scaffold leg. Given that the scaffold legs are typically connected to adjacent scaffold legs by means of braced arrangements and horizontal-type members, the upper scaffold leg cannot be inadvertently moved to a release position.

Preferably the coupling spigot 2 is mechanically secured to the lower scaffold leg 70 in a permanent type manner as the coupling spigot 2 typically remains connected to the leg. The coupling spigot 2 may be removed and replaced if damaged or to accommodate a different component such as a jack. The coupling spigot 2 as shown in FIG. 1 also includes ports 35 in the upper portion 4 to allow the coupling spigot to function with a traditional scaffold leg that does not include the locking projections. In this case traditional gravity lock type pins can be used.

It has been found that this arrangement provides an effective, simple means for connecting scaffold legs one to the other.

Figure 8:
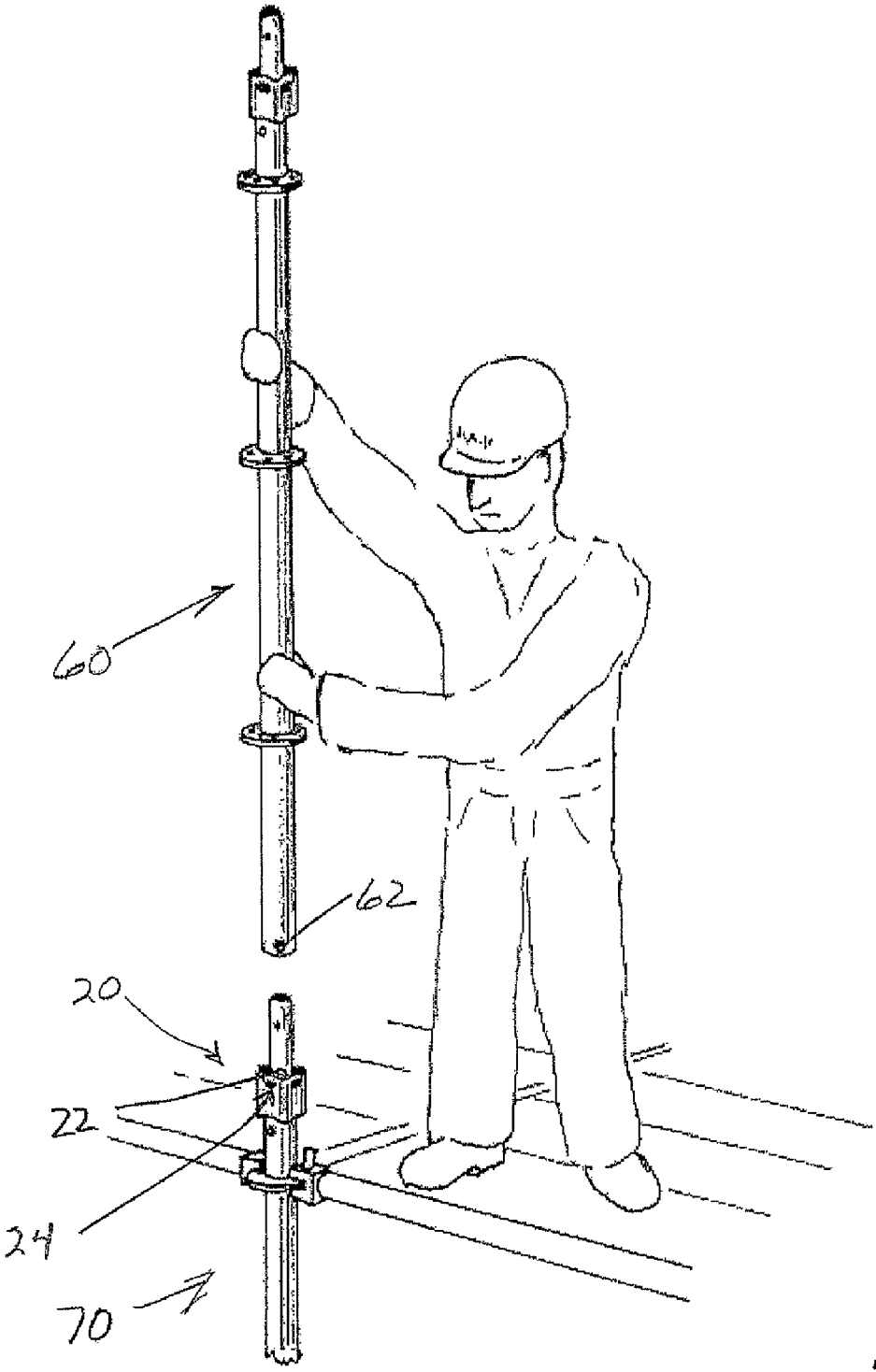
FIG. 8 is a partial perspective view of a scaffold leg being secured on a lower scaffold leg.

FIG. 8 schematically illustrates the securement of the upper scaffold leg 60 to the lower scaffold leg 70 via the coupling spigot 2. The locking projections 62 are aligned with opposed receiving slots 22 of the locking collar 20. Once the bottom of the upper leg 60 is supported by the stop collar 10 of the coupling spigot, the upper scaffold leg can be rotated for locking of the projections 62 in the locking slots 24.

A series of connecting rosettes 90 are provided on each scaffold leg for connecting ledgers and bracing members to the scaffold legs.

Although various preferred embodiments of the present invention have been described herein in detail, it will be appreciated by those skilled in the art, that variations may be made thereto without departing from the scope of the appended claims.

The embodiments of the invention in which an exclusive property or privilege is claimed are defined as follows:

1. A scaffold coupling system comprising a coupling spigot connecting upper and lower tubular scaffold legs the coupling spigot assembly comprising a spigot having opposing ends, each end sized for insertion within a respective one of the upper and lower scaffold legs, a stop collar projecting outwardly from and secured to said spigot forming stop faces for abutting with an end of each of said upper and lower scaffold legs respectively, an upwardly opening locking collar secured to and positioned outwardly of said spigot and receiving the end of said upper scaffold leg between said locking collar and said spigot; said locking collar including a first receiving slot exterior to said spigot receiving a locking projection extending outwardly from and provided on said upper scaffold leg allowing said upper scaffold leg to engage and be supported by one of the faces of said stop collar and a first locking slot associated with said first receiving slot positioned to allow rotation of said upper scaffold leg about a longitudinal axis thereof when supported by said stop collar to restrain said locking projection in said first locking slot preventing axial separation of said upper scaffold leg without removal of said locking projection from said first locking slot.

2. The scaffold coupling system as claimed in claim 1 wherein said locking collar includes a second locking slot and a second receiving slot in said locking collar that additionally receives a further locking projection provided on said upper scaffold leg.

3. The scaffold coupling system as claimed in claim 2 wherein said locking collar is fixedly secured to said stop collar.

4. The scaffold coupling system as claimed in claim 2 including third and fourth receiving slots and third and fourth locking slots.

5. The scaffold coupling system as claimed in claim 4 wherein said spigot includes a horizontally extending port for receiving a clevis pin for locking said spigot to said lower scaffold leg.

6. The scaffold coupling system as claimed in claim 5 wherein said locking collar above said stop collar defines a gap sized to receive said upper scaffold leg.

7. The scaffold coupling system as claimed in claim 5 wherein said four receiving slots form outwardly projecting portions of said locking collar disposed approximately 90 degrees apart.

8. The scaffold coupling system as claimed in claim 7 wherein each of said four locking slots extend between one of said receiving slots and a reduced diameter portion of said locking collar located between two adjacent outwardly projecting portions.

9. The scaffold coupling system as claimed in claim 8 wherein said receiving slots form vertically extending receiving channels connected to said horizontally extending locking slots such that each receiving slot cooperates with one of said locking slots to form an "L" shaped slot.

10. The scaffold couplingv as claimed in claim 1 wherein said locking collar is non-pivotally secured to said spigot.

11. The scaffold coupling system as claimed in claim 1 wherein said spigot above said stop collar includes a central port extending horizontally through said spigot for receiving a locking pin to lock said second scaffold leg to said spigot coupling.

* * * * *